US007182695B1

(12) United States Patent
Tostenson et al.

(10) Patent No.: US 7,182,695 B1
(45) Date of Patent: Feb. 27, 2007

(54) ASSISTED JUMP RIDE

(75) Inventors: David Tostenson, Auburn, CA (US); Jeffrey Dean Wilson, New Castle, CA (US)

(73) Assignee: Extreme Engineering, New Castle, CA (US)

( * ) Notice: Subject to any disclaimer, the term of this patent is extended or adjusted under 35 U.S.C. 154(b) by 0 days.

(21) Appl. No.: 10/991,952

(22) Filed: Nov. 17, 2004

Related U.S. Application Data

(60) Provisional application No. 60/523,300, filed on Nov. 17, 2003.

(51) Int. Cl.
*A63G 31/04* (2006.01)

(52) U.S. Cl. ..... 472/50; 472/3; 472/133

(58) Field of Classification Search ..... 472/3, 472/49, 50, 39, 131, 133, 135; 482/27, 29
See application file for complete search history.

(56) References Cited

U.S. PATENT DOCUMENTS

| | | | | |
|---|---|---|---|---|
| 3,885,788 | A * | 5/1975 | Harris | 472/135 |
| 5,064,191 | A * | 11/1991 | Johnson | 482/143 |
| 5,203,744 | A * | 4/1993 | Checketts | 472/131 |
| 5,632,686 | A * | 5/1997 | Checketts | 472/131 |
| 6,511,383 | B1 * | 1/2003 | Raidt et al. | 472/135 |
| 6,988,951 | B1 * | 1/2006 | Newman et al. | 472/39 |

* cited by examiner

*Primary Examiner*—Kien Nguyen
(74) *Attorney, Agent, or Firm*—Sierra Patent Group, Ltd.

(57) ABSTRACT

The present disclosure relates to a ride for providing an upward boost to a participant jumping up and down. The flexible rods of this disclosure may be articulated by a base thereby imparting tension in the flexible rods, and providing an upward force to a participant jumping up and down. Additionally, elastic pods may be provided, allowing participants to bounce upward in a addition to the lift provided by the flexible members, thereby enhancing the participant's experience.

4 Claims, 3 Drawing Sheets

ASSISTED JUMP RIDE

CROSS REFERENCE TO RELATED APPLICATIONS

This application claims the benefit of U.S. Provisional Patent Application Ser. No. 60/523,300, filed Nov. 17, 2003.

BACKGROUND

1. Field of the Disclosure

The disclosure relates generally to a ride featuring flexible members for lifting and oscillating participants.

2. The Prior Art

BACKGROUND

Competition for potential riders attention at county fairs and the like is becoming increasingly difficult. In addition to traditional rides such as Ferris wheels, electronic games in midways attract fairgoers.

Recently, many action rides, such as rock climbing apparatus, have become popular as riders desire to participate in activities that are physical in nature, as opposed to traditional rides where the rider remains passive throughout the ride.

BRIEF DESCRIPTION OF THE DRAWING FIGURES

DETAILED DESCRIPTION

Figure 1:
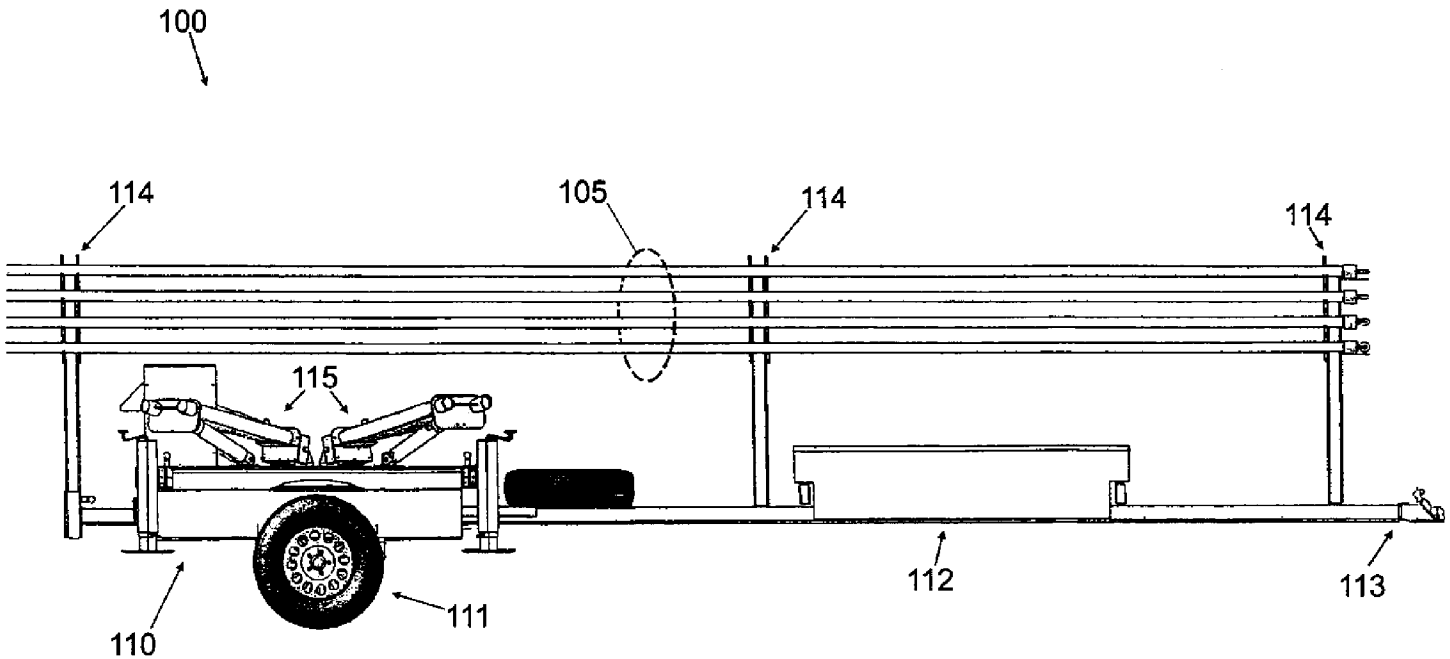
FIG. 1 is a side view of a flexible rod ride system in accordance with the teachings of this disclosure.

Persons of ordinary skill in the art will realize that the following description is illustrative only and not in any way limiting. Other modifications and improvements will readily suggest themselves to such skilled persons having the benefit of this disclosure. In the following description, like reference numerals refer to like elements throughout.

The present disclosure relates to a ride for providing an upward boost to a participant jumping up and down. The flexible rods of this disclosure may be articulated by a base thereby imparting tension in the flexible rods, and providing an upward force to a participant jumping up and down. Additionally, elastic pods may be provided, allowing participants to bounce upward in addition to the lift provided by the flexible members, thereby enhancing the participant's experience.

FIG. 1 is a side diagram of a trailer and ride system 100 configured in accordance with the teachings of this disclosure. The ride 100 includes one or more flexible rods 105.

In a preferred embodiment, the flexible rods 105 may comprise a flexible material having tensile and compressive loading capabilities chosen to handle the forces necessary to support riders in a wide variety of weight groups while providing a reasonable margin for failure. In a preferred embodiment, the rods 105 comprise a composite material such as a polyester resin. The resin may have unbiased linear strands, i.e., strands that are oriented parallel to the longitudinal axis of the member. For example, the flexible members may comprise a glass matrix polyester resin having fibers running co-axial with the member. In a preferred embodiment, the rods are approximately 24 feet in length, though other configurations are possible.

The ride 100 further includes a trailer 110 for transporting the ride to sites. The trailer 110 may include conventional features as is known in the art, such as wheel and axle assembly 111, a storage area 112, and a hitch and tongue assembly 113. The rods 105 may be coupled for storage to the trailer by racks 114.

The ride 100 includes one or more articulating base units 115. The articulating base units 115 are preferably configured to rotate the rods in manner more fully described below.

Figure 2:
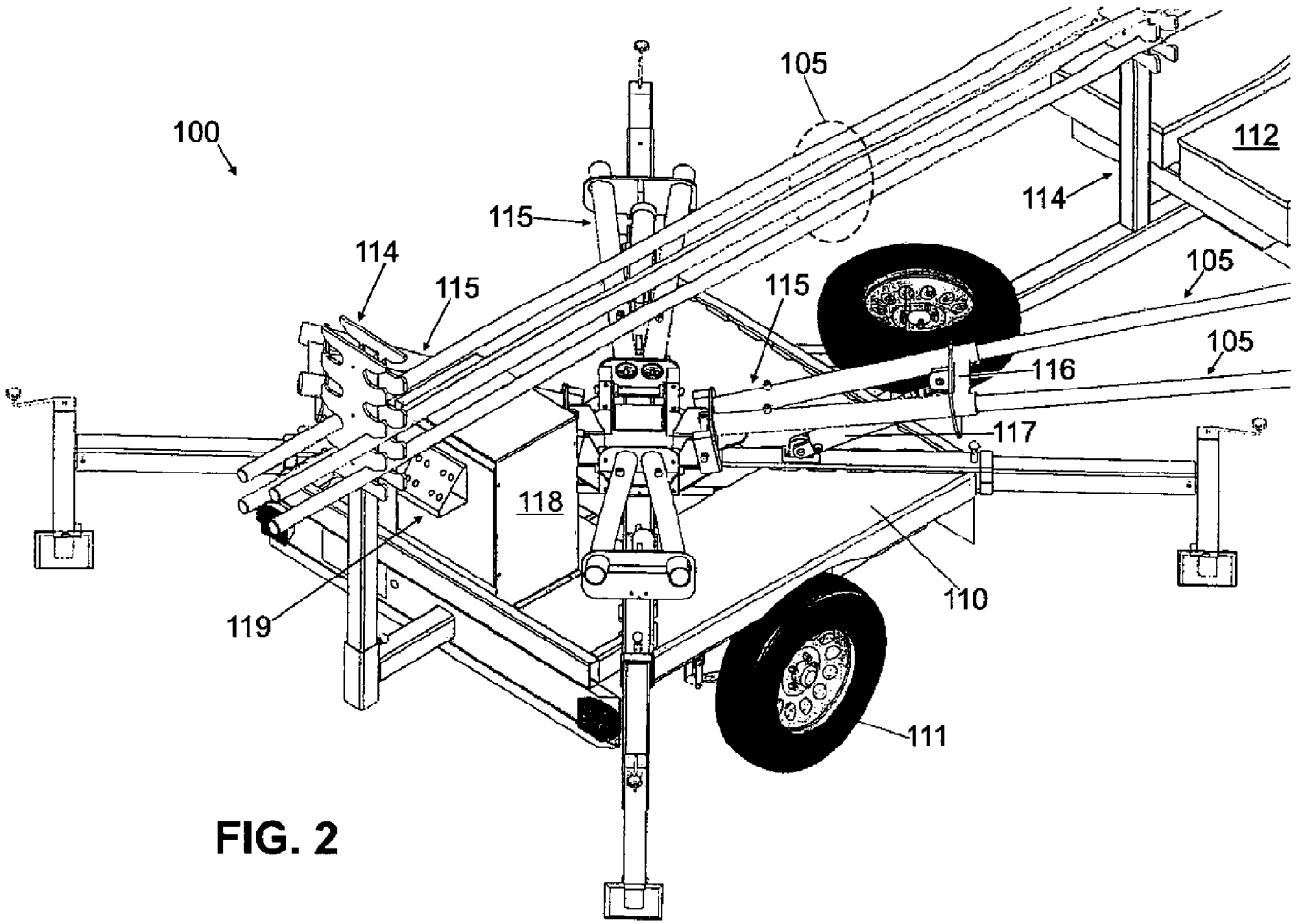
FIG. 2 is a more detailed view of a flexible rod ride system in accordance with the teachings of this disclosure.

Referring now to FIG. 2, a more detailed illustration of the system 100 is shown, focusing on the end of trailer 110 housing the base units 115.

The articulating base units 115 preferably include a mounting clamp 116 for attaching the rod 105. The articulating base unit 115 may include a pneumatic or mechanical device 117 configured to impart a moment on the rods, thereby imparting a traverse tension on the member and preloading force into the member as will be more fully described below.

The ride 100 is operated using pneumatics housed in housing 118 and controlled through a control panel 119. It is contemplated that the ride may be controlled by an operator, such as an attendant, or may be under computer control.

Figure 3:
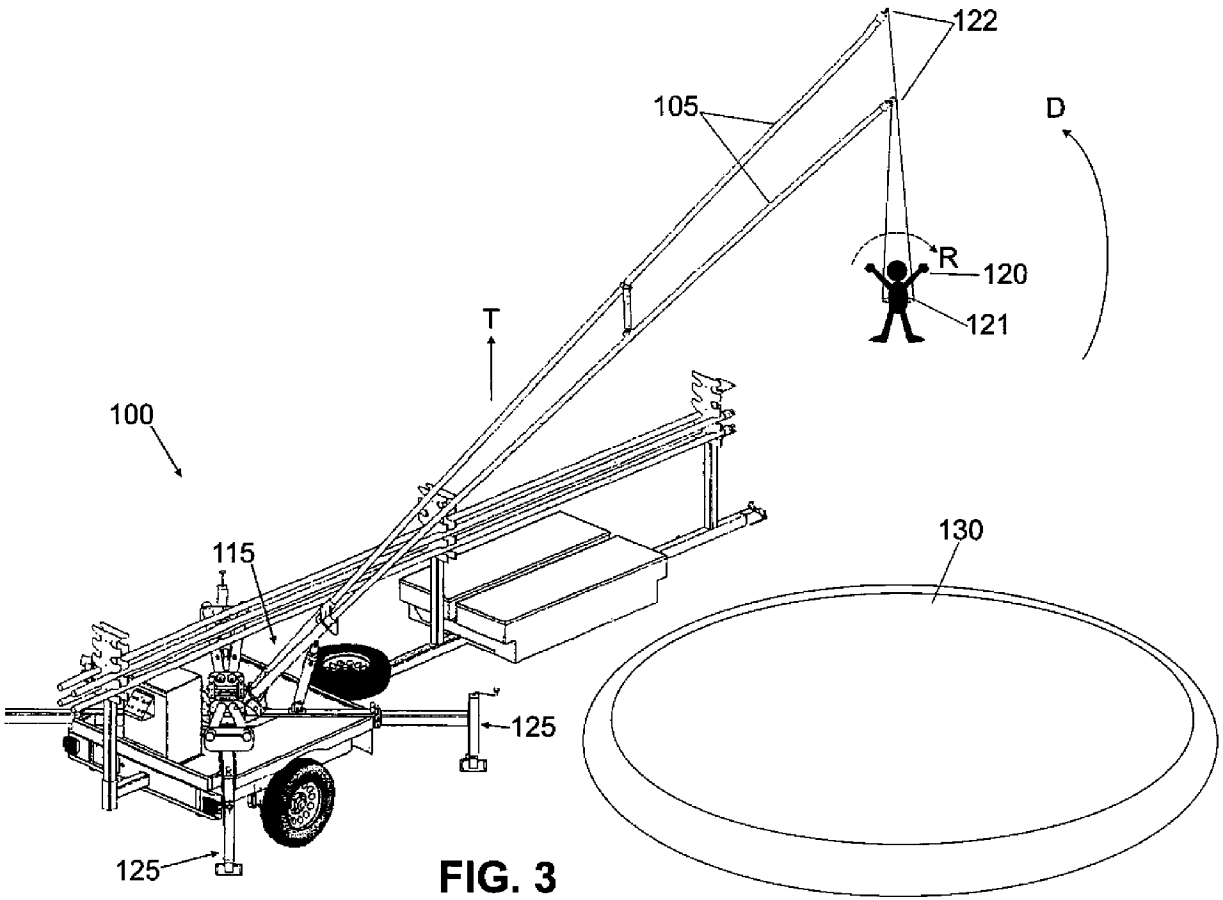
FIG. 3 is a flexible rod ride system in operation in accordance with the teachings of this disclosure.

FIG. 3 is a diagram of a ride system 100 in operation. In operation, a rider 120 will stand adjacent to a harness 121 that is coupled to the pair of members 105. As will be appreciated, while one member may suffice to provide the benefits of this disclosure, utilizing a pair of members provides for a safety redundancy in the event of a failure of one of the members.

The harness 121 may comprise conventional climbing harness, however, in one preferred embodiment, straps attached to the rods join the harness proximate to the rider's hips, allowing a rider to tip forward and backward along a direction R.

At the time when the rider is strapped into the harness, there is no tension of the rods 105. After the rider 120 is securely strapped in, the operator may begin to lift the tip 122 (rider end) of the rod by activating the articulating the base end of the rods 105 using the articulating base unit 115. As the articulating base rotates upward about a direction D, the straps of the harness are tightened, and a bending force is applied to the rod 105 as the rider remains stationary. The operator may continue to charge the rod until a predetermined amount of tension is applied. Hence, the bending force supplied by the base provides a source of potential energy stored in the rods as tension T.

It is contemplated that an operator may be trained to stop applying a bending force when the rod curves to predefined radius, or the tension in the rod may be monitored by sensors known in the art. When a proper amount of tension has been preloaded, the articulating base unit 115 may be stopped, and the ride may begin.

When the rider 120 jumps upward, the tension of the rods provides an additional upward spring force, allowing a rider to jump farther upward than normally possible. Hence, the more tension applied to the rod, the higher a rider may jump.

Accordingly, the present disclosure provides for pre-charging a ride with tensile energy, and allowing the energy to be release so as to propel a rider upward. Preferably, the energy is stored and released such that the harmonic resonance created by the system has a frequency that allows a rider to re-tension the rod upon descent using their weight, and re-activate the force by jumping upward, thereby enjoying an assisted jump experience repeatedly.

It is contemplated that additional springing motion may be provided by having spring mechanisms disposed in the articulating base unit configured to provide an additional assisted upward force to the rider. It is contemplated that such additional spring forces may comprise mechanical or hydraulic devices, or additional elastomer materials coupled between the rod and the base.

Anti-rotational stabilizing supports 125 may be provided to stabilize the ride. The supports may be slidably mounted on the trailer, allowing the supports to be deployed when the trailer reaches a site. The supports may include convention trailer drop jacks as is known in the art. The supports are preferably aligned with the moment's forces provided by the base and rods to more effectively stabilize the ride.

The present invention may be configured to provide a ride for a single rider, or multiple riders. In the embodiments shown in the figures, a four-rider capacity is shown, though other capacities are possible. Additionally, the system 100 may be configured to allow the base units to detach from the trailer, and the ride may be installed directly on the ground.

Pads 130 may also be provided having elastic qualities, such as trampolines. The pads may allow users to enjoy the ride while minimizing the impact of the ground, and may add to the upward force.

While embodiments and applications of this disclosure have been shown and described, it would be apparent to those skilled in the art that many more modifications and improvements than mentioned above are possible without departing from the inventive concepts herein. The disclosure, therefore, is not to be restricted except in the spirit of the appended claims.

What is claimed is:

1. An assisted jump ride system comprising:

an articulating base unit;

one or more flexible rods having a base end and a rider end;

said base end of said flexible rods coupled to said articulating base unit and said rider end of said rods being configured to secure a rider in a harness; and said articulating unit being configured to pre-charge said rods with tensile energy such that said energy is released when said rider jumps upward, providing an additional upward force to said rider, wherein a plurality of articulating base units are coupled to a trailer, and a pair of said flexible rods are provided for each of said articulating base units.

2. The assisted jump ride system of claim 1, wherein a rider is coupled to said rider end of said rods using a harness and straps, said straps being coupled proximate to said rider's hips.

3. An assisted jump ride apparatus comprising:

articulating base unit means;

flexible rod means having a base end and a rider end;

said base end of said flexible rod means coupled to said articulating base unit means and said rider end of said rods being configured to secure a rider in a harness; and said articulating base unit means being configured to pre-charge said rods with tensile energy such that said energy is released when said rider jumps upward, providing an additional upward force to said rider, wherein a plurality of articulating base unit means are coupled to a trailer, and a pair of said flexible rod means are provided for each of said articulating base rods.

4. The assisted jump ride system of claim 3, wherein a rider is coupled to said rider end of said rods using a harness and straps, said straps being coupled proximate to said rider's hips.

* * * * *